US011293707B1

(12) United States Patent
Lee et al.

(10) Patent No.: US 11,293,707 B1
(45) Date of Patent: Apr. 5, 2022

(54) DETACHABLE CHARGING HANDLE FOR PISTOLS

(71) Applicant: Strike Industries, Inc., Santa Ana, CA (US)

(72) Inventors: Shanyao Lee, Santa Ana, CA (US); Felix Danishwara, Santa Ana, CA (US)

(73) Assignee: Strike Industries, Inc., Santa Ana, CA (US)

( * ) Notice: Subject to any disclaimer, the term of this patent is extended or adjusted under 35 U.S.C. 154(b) by 0 days.

(21) Appl. No.: 17/205,125

(22) Filed: Mar. 18, 2021

(51) Int. Cl.
*F41A 3/72* (2006.01)
*F41C 3/00* (2006.01)

(52) U.S. Cl.
CPC . *F41A 3/72* (2013.01); *F41C 3/00* (2013.01)

(58) Field of Classification Search
CPC ..... F41C 27/00; F41A 3/72
See application file for complete search history.

(56) References Cited

U.S. PATENT DOCUMENTS

| | | | | |
|---|---|---|---|---|
| 2,903,810 | A * | 9/1959 | Lewis | F41C 23/10 42/71.02 |
| 9,291,413 | B1 * | 3/2016 | Viani | F41C 27/00 |
| 2012/0198744 | A1 * | 8/2012 | Meller | F41C 3/00 42/90 |
| 2014/0047750 | A1 * | 2/2014 | Siddle | F41C 23/10 42/1.01 |
| 2015/0354909 | A1 * | 12/2015 | Tarantino | F41A 3/72 89/1.4 |
| 2018/0195819 | A1 * | 7/2018 | Porat | F41A 3/72 |

* cited by examiner

*Primary Examiner* — J. Woodrow Eldred
(74) *Attorney, Agent, or Firm* — Han IP PLLC; Andy M. Han

(57) ABSTRACT

A device implementable on a firearm includes a charging handle configured to be mounted on a lateral side of a slide of the firearm by a screw and without removal of a rear sight or a slide cover plate at a breech end of the slide. The charging handle includes a handle member and at least one screw. The handle member is adapted to engage the lateral side of the slide. The handle member has at least one threaded through hole traversing a body of the handle member. The at least one screw is configured to secure the handle member to the slide through the at least one threaded through hole when the at least one threaded through hole is aligned with a tapped hole on the slide.

20 Claims, 3 Drawing Sheets

DETACHABLE CHARGING HANDLE FOR PISTOLS

TECHNICAL FIELD

The present disclosure is generally related to firearm accessories and, more particularly, to a detachable charging handle for pistols.

BACKGROUND

Unless otherwise indicated herein, approaches described in this section are not prior art to the claims listed below and are not admitted as prior art by inclusion in this section.

A slide or slide assembly is a spring-loaded component as an upper part of a fully-automatic or semi-automatic pistol that slides back and forth, or reciprocates, with recoil when rounds of ammunition are fired during the pistol's operating cycle. Whether the pistol is double-action or single-action, a user typically needs to rack the slide by pulling the slide rearward and then release it to load a first round of ammunition cartridge from the magazine of into the chamber. However, even if there are serrations on the slide to allow better grip by the fingers of the user when racking the slide, often time it is still difficult for the user to rack the slide especially when the recoil spring in the slide assembly is relatively new and still strong. Although there currently exist some aftermarket products or pistols with features that aim to address this issue, removal of the rear sights and/or slide cover plate at the breech end of the slide is typically required. Moreover, some of the existing designs tend to be complicated and require many components, thereby increasing overall cost.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In view of the aforementioned issues, an objective of the present disclosure is to propose innovative designs of a detachable charging handle for pistols. It is believed that the proposed designs may address aforementioned issue associated with conventional slides as well as issues associated with existing designs. For instance, under various proposed designs in accordance with the present disclosure, a charging handle may be detachably mounted on a lateral side of a slide of a pistol by a screw and without removal of a rear sight or a slide cover plate at a breech end of the slide.

In one aspect, a device implementable on a firearm (e.g., fully-automatic or semi-automatic pistol) may include a charging handle configured to be mounted on a lateral side of a slide of the firearm by a screw and without removal of a rear sight or a slide cover plate at a breech end of the slide.

In another aspect, a device implementable on a firearm (e.g., fully-automatic or semi-automatic pistol) may include a charging handle configured to be mounted on a slide of the firearm. The charging handle may include a handle member and at least one screw. The handle member may be adapted to engage a lateral side of the slide, and the handle member may have at least one threaded through hole traversing a body of the handle member. The at least one screw may be configured to secure the handle member to the slide through the at least one threaded through hole when the at least one threaded through hole is aligned with a tapped hole on the slide.

In yet another aspect, a device implementable on a firearm (e.g., fully-automatic or semi-automatic pistol) may include a slide and a charging handle. The slide may be configured to be slidingly mounted on a frame of the firearm. A lateral side of the slide may be configured with a tapped hole. The charging handle may be configured to be mounted on the slide. The charging handle may include a handle member and at least one screw. The handle member may be adapted to engage the lateral side of the slide, and the handle member may have at least one threaded through hole traversing a body of the handle member. The at least one screw may be configured to secure the handle member to the slide through the at least one threaded through hole when the at least one threaded through hole is aligned with the tapped hole on the slide.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, explain the principles of the disclosure. It is appreciable that the drawings are not necessarily in scale as some components may be shown to be out of proportion than the size in actual implementation to clearly illustrate the concept of the present disclosure.

DETAILED DESCRIPTION OF PREFERRED IMPLEMENTATIONS

Figure 1:
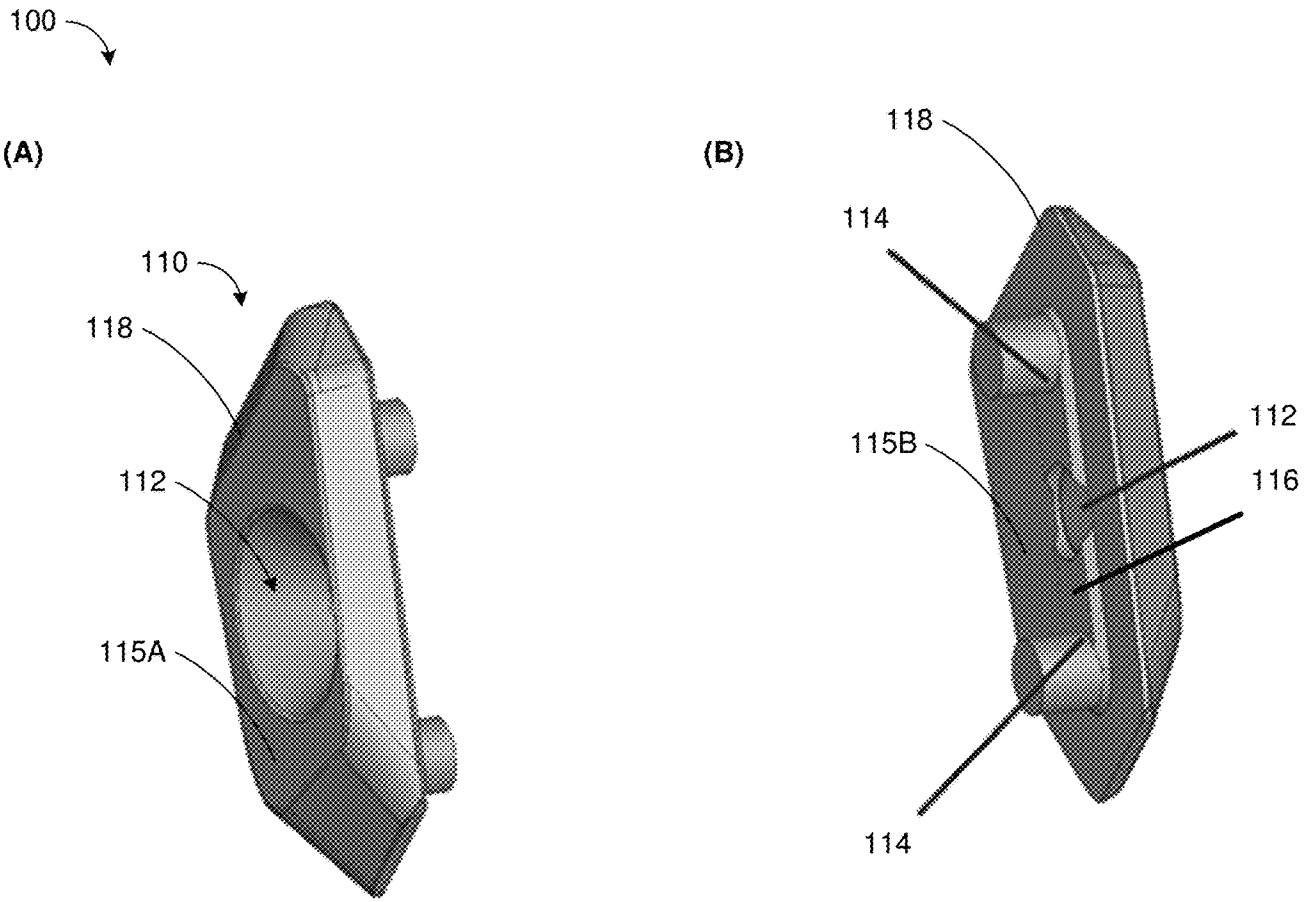
FIG. 1 is a diagram of a device in accordance with an implementation of the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g., 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

Figure 2:
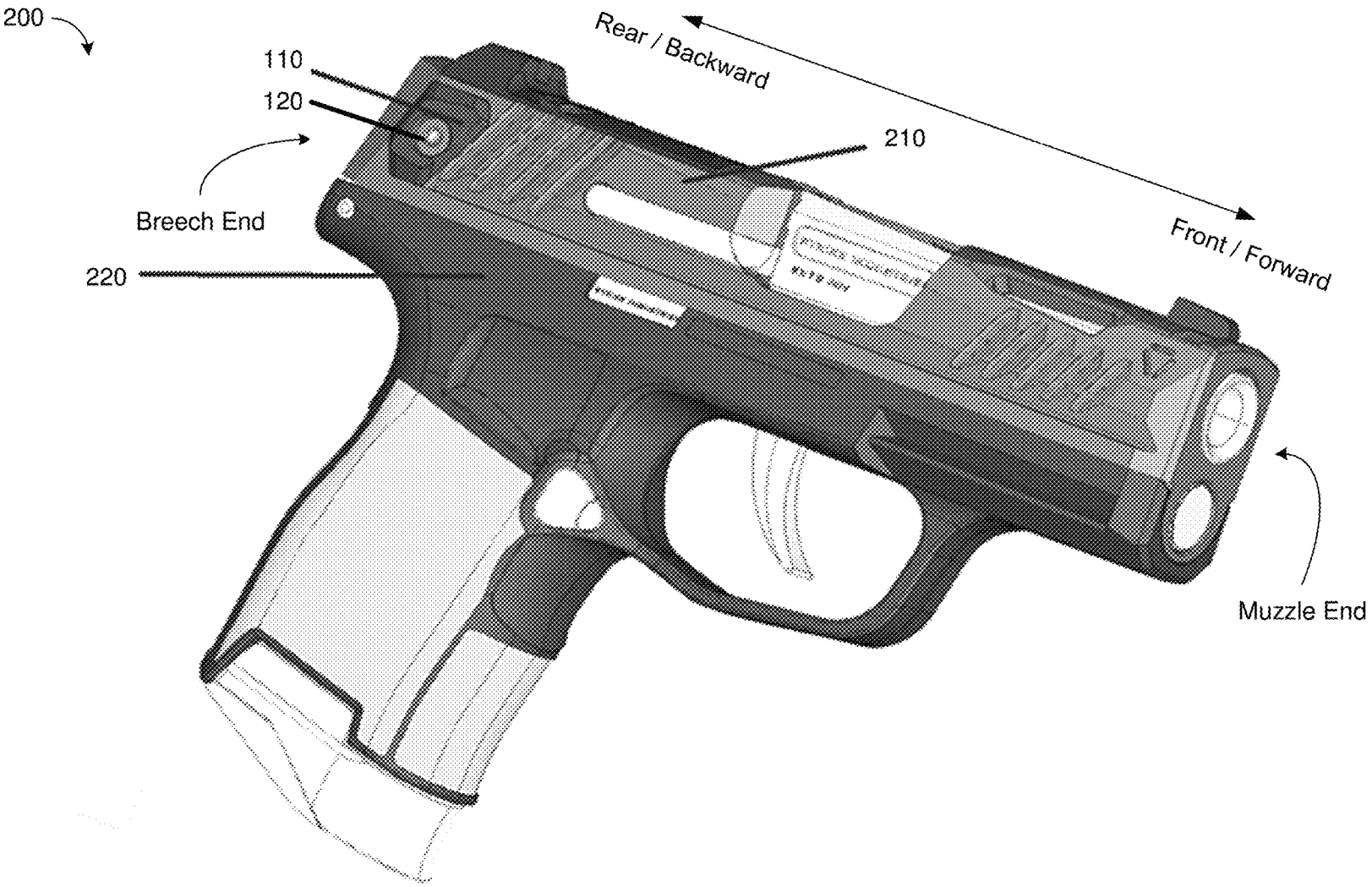
FIG. 2 is a diagram of an apparatus in accordance with an implementation of the present disclosure.
Figure 3:
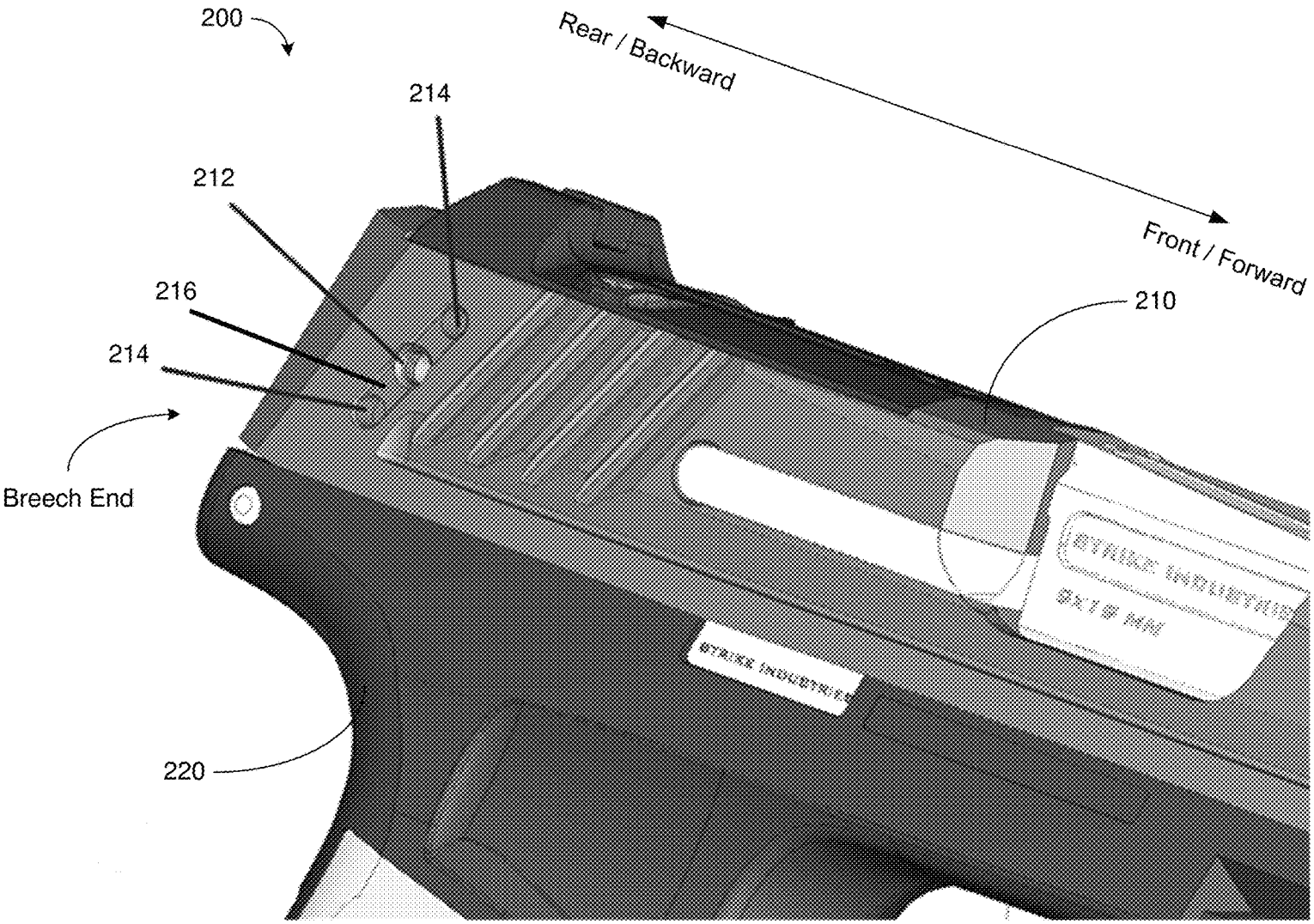
FIG. 3 is a diagram of a close-up view of a proportion of an apparatus in accordance with an implementation of the present disclosure.

FIG. 1 illustrates a device 100 in accordance with an implementation of the present disclosure. FIG. 2 and FIG. 3 each illustrates an apparatus 200 on which device 100 may be implemented or otherwise installed. Device 100 may be implementable on apparatus 200 as a firearm, such as a fully-automatic or semi-automatic pistol. Referring to FIG. 1-FIG. 3, apparatus 200 as a firearm may include at least a slide 210 and a frame 220. Slide 210 may be slidingly installed on frame 220. Device 100 may include a charging handle configured to be mounted on a lateral side (e.g., left side or right side) of a slide 210 of the firearm by a screw and without removal of a rear sight or a slide cover plate at a breech end of the slide 210.

Referring to FIG. 1-FIG. 3, the charging handle of device 100 may include a handle member 110 and at least one screw 120. The handle member 110 may be adapted to engage the lateral side (e.g., left side or right side) of the slide 210. Moreover, the handle member 110 may have a threaded through hole 112 traversing a body 118 of the handle member 110. The screw 120 may be configured to secure the handle member 110 to the slide 210 through the threaded through hole 112 when the threaded through hole 112 is aligned with a tapped hole 212 on the slide 210.

Under a proposed design, the handle member 110 may have a user-engagement side 115A and a mating side 1158 opposite the user-engagement side 115A. When charging handle 110 is installed on the slide 210, the user-engagement side 115A faces outwardly and is intended to be grabbed, pulled or otherwise utilized by a user in racking the slide 210. The mating side 1158 may have at least one post 114 (e.g., two of such posts 114 shown in FIG. 1) protruding from the mating side 115B. The at least one post 114 may be configured to be received in a corresponding indentation 214 (e.g., two of such indentation 214 shown in FIG. 3) on the lateral side of the slide 210 when the charging handle 110 is installed on the slide 210 with the mating side 1158 in physical contact with the lateral side of slide 210.

Under a proposed design, the mating side 1158 of the handle member 110 may also have a ridge 116 protruding from the mating side 1158 and extending between each of the at least one post 114 and the threaded through hole 112. The ridge 116 may be configured to be received in a corresponding groove 216 on the lateral side of the slide 210 when the charging handle 110 is installed on the slide 210. The groove 216 may extend between each indentation 214 and the tapped hole 212. Together, the post 114, ridge 116, indentation 214 and groove 216 help allow handle member 110 to be securely and fixedly mounted on a lateral side of slide 210, thereby avoiding any rotational movement (e.g., when screw 120 is turned clockwise during installation of handle member 110 and when screw 120 is turned counter-clockwise during removal of handle member 110).

Under a proposed design, a head of the screw 120 may be exposed and visible when the charging handle 110 is installed on the slide 210, as shown in FIG. 2.

Under a proposed design, a material of the handle member 110 may include metal. Alternatively, or additionally, the material of the handle member 110 may include polymer.

It is noteworthy that, although in the description above a singular handle member 110 is described, in various implementations of the proposed designs the charging handle of device 100 may include two of such handle member 110 and at least two of screws 120 such that each of the two handle members 110 is installed on a respective lateral side (left or right side) of the slide 210 and secured by the corresponding screw 120.

It is also noteworthy that, although in the description above a singular screw 120 is described and shown, in various implementations of the proposed designs each handle member 110 may have more than one threaded through hole 112 so as to be secured by more than one screw 120 onto the slide 210.

It is further noteworthy that, although two posts 114 and two indentations 214 are shown in FIG. 1 and FIG. 3, in various implementations of the proposed designs there may be a single post 114 and a single indentation 214 or, alternatively, there may be more than two posts 114 and more than two indentations 214.

It is additionally noteworthy that, although in FIG. 2 and FIG. 3 the charging handle is shown to be mounted near the rear end (or breech end) of the slide 210 and tapped hole 212, indentations 214 and groove 216 are shown to be located near the rear end (or breech end) of the slide 210, in various implementations of the proposed the charging handle of device 100 may be installed at other locations on either or both lateral sides of slide 210, such as in front of or behind an ejection port of the slide 210 or near the front end (or muzzle end) of the slide 210. Correspondingly, tapped hole 212, indentations 214 and groove 216 may be located at other locations on either or both lateral sides of slide 210, such as near the front end (or muzzle end) of the slide 210.

Advantageously, under various proposed designs in accordance with the present disclosure, a charging handle of device 100 may be detachably mounted on a lateral side of a slide of a pistol by a screw. This makes it relatively easy to install as well as detach/remove device 100, and the installation and removal may be executed without removal of a rear sight or a slide cover plate at a breech end of the slide as with some of the existing designs.

Example Implementations

In view of the above, the proposed design of a modular forward assist may be implemented in many ways. For illustrative purposes and without limiting the scope of the present disclosure, a few example implementations of the proposed design are described below.

In one aspect, a device implementable on a firearm (e.g., fully-automatic or semi-automatic pistol) may include a charging handle configured to be mounted on a lateral side of a slide of the firearm by a screw and without removal of a rear sight or a slide cover plate at a breech end of the slide.

In some implementations, the charging handle may include a handle member and the screw. The handle member may be adapted to engage the lateral side of the slide, and the handle member may have a threaded through hole traversing a body of the handle member. The screw may be configured to secure the handle member to the slide through the threaded through hole when the threaded through hole is aligned with a tapped hole on the slide.

In some implementations, a mating side of the handle member may have a post protruding from the mating side and configured to be received in a corresponding indentation on the lateral side of the slide when the charging handle is installed on the slide with the mating side in physical contact with the lateral side of slide.

In some implementations, the mating side of the handle member may also have a ridge protruding from the mating side and extending between the post and the threaded through hole. The ridge may be configured to be received in a corresponding groove on the lateral side of the slide when the charging handle is installed on the slide.

In some implementations, a head of the screw may be exposed and visible when the charging handle is installed on the slide.

In some implementations, a material of the handle member may include metal. Alternatively, or additionally, the material of the handle member may include polymer.

In another aspect, a device implementable on a firearm (e.g., fully-automatic or semi-automatic pistol) may include a charging handle configured to be mounted on a slide of the firearm. The charging handle may include a handle member and at least one screw. The handle member may be adapted to engage a lateral side of the slide, and the handle member may have at least one threaded through hole traversing a body of the handle member. The at least one screw may be configured to secure the handle member to the slide through the at least one threaded through hole when the at least one threaded through hole is aligned with a tapped hole on the slide.

In some implementations, a mating side of the handle member may have a post protruding from the mating side and configured to be received in a corresponding indentation on the lateral side of the slide when the charging handle is installed on the slide with the mating side in physical contact with the lateral side of slide.

In some implementations, the mating side of the handle member may also have a ridge protruding from the mating side and extending between the post and the at least one threaded through hole. The ridge may be configured to be received in a corresponding groove on the lateral side of the slide when the charging handle is installed on the slide.

In some implementations, a head of the screw may be exposed and visible when the charging handle is installed on the slide.

In some implementations, a material of the handle member may include metal. Alternatively, or additionally, the material of the handle member may include polymer.

In yet another aspect, a device implementable on a firearm (e.g., fully-automatic or semi-automatic pistol) may include a slide and a charging handle. The slide may be configured to be slidingly mounted on a frame of the firearm. A lateral side of the slide may be configured with a tapped hole. The charging handle may be configured to be mounted on the slide. The charging handle may include a handle member and at least one screw. The handle member may be adapted to engage the lateral side of the slide, and the handle member may have at least one threaded through hole traversing a body of the handle member. The at least one screw may be configured to secure the handle member to the slide through the at least one threaded through hole when the at least one threaded through hole is aligned with the tapped hole on the slide.

In some implementations, the lateral side of the slide may also be configured with an one indentation approximate the tapped hole.

In some implementations, a mating side of the handle member may have at least one post protruding from the mating side and configured to be received in the at least one indentation on the lateral side of the slide when the charging handle is installed on the slide with the mating side in physical contact with the lateral side of slide.

In some implementations, the lateral side of the slide may further be configured with a groove connecting the indentation and the tapped hole. Correspondingly, the mating side of the handle member may also have a ridge protruding from the mating side and extending between the post and the at least one threaded through hole. Accordingly, the ridge may be configured to be received in the groove on the lateral side of the slide when the charging handle is installed on the slide.

In some implementations, a head of the screw may be exposed and visible when the charging handle is installed on the slide.

In some implementations, a material of the handle member may include metal. Alternatively, or additionally, the material of the handle member may include polymer.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A device implementable on a firearm, comprising:

a charging handle having a threaded through hole and configured to be mounted on a lateral side of a slide of a slide assembly of the firearm by a screw through the threaded through hole and without removal of a rear sight or a slide cover plate at a breech end of the slide, wherein the changing handle has a user-engagement side and a mating side opposite the user-engagement side, wherein the threaded through hole traverses the charging handle between the user-engagement side and the mating side, wherein the mating side is configured to contact and mate with the lateral side of the slide when the charging handle is mounted on the lateral side of the slide, wherein the user-engagement side faces outwardly toward a left side or a right side of the firearm when the charging handle is mounted on the lateral side of the slide, and wherein both the threaded through hole and the screw are on the lateral side of the slide when the charging handle is mounted on the lateral side of the slide.

2. The device of claim 1, wherein the charging handle comprises:

a handle member adapted to engage the lateral side of the slide, the handle member having the threaded through hole traversing a body of the handle member; and the screw which is configured to secure the handle member to the slide through the threaded through hole when the threaded through hole is aligned with a tapped hole on the slide.

3. The device of claim 2, wherein the mating side of the handle member has a post protruding from the mating side and configured to be received in a corresponding indentation on the lateral side of the slide when the charging handle is installed on the slide with the mating side in physical contact with the lateral side of slide.

4. The device of claim 3, wherein the mating side of the handle member also has a ridge protruding from the mating side and extending between the post and the threaded through hole, and wherein the ridge is configured to be received in a corresponding groove on the lateral side of the slide when the charging handle is installed on the slide.

5. The device of claim 2, wherein a head of the screw is exposed and visible when the charging handle is installed on the slide.

6. The device of claim 2, wherein a material of the handle member comprises metal.

7. The device of claim 2, wherein a material of the handle member comprises polymer.

8. A device implementable on a firearm, comprising:

a charging handle configured to be mounted on a slide of a slide assembly of the firearm, the charging handle comprising:

a handle member adapted to engage a lateral side of the slide, the handle member having at least one threaded through hole traversing a body of the handle member; and at least one screw configured to secure the handle member to the slide through the at least one threaded through hole when the at least one threaded through hole is aligned with a tapped hole on the slide, wherein the handle member has a user-engagement side and a mating side opposite the user-engagement side, wherein the at least one threaded through hole traverses the handle member between the user-engagement side and the mating side, wherein the mating side is configured to contact and mate with the lateral side of the slide when the charging handle is mounted on the lateral side of the slide, wherein the user-engagement side faces outwardly toward a left side or a right side of the firearm when the charging handle is mounted on the lateral side of the slide, and wherein both the at least one threaded through hole and the at least one screw are on the lateral side of the slide when the charging handle is mounted on the lateral side of the slide.

9. The device of claim 8, wherein the mating side of the handle member has a post protruding from the mating side and configured to be received in a corresponding indentation on the lateral side of the slide when the charging handle is installed on the slide with the mating side in physical contact with the lateral side of slide.

10. The device of claim 9, wherein the mating side of the handle member also has a ridge protruding from the mating side and extending between the post and the at least one threaded through hole, and wherein the ridge is configured to be received in a corresponding groove on the lateral side of the slide when the charging handle is installed on the slide.

11. The device of claim 8, wherein a head of the screw is exposed and visible when the charging handle is installed on the slide.

12. The device of claim 8, wherein a material of the handle member comprises metal.

13. The device of claim 8, wherein a material of the handle member comprises polymer.

14. A device implementable on a firearm, comprising:

a slide of a slide assembly configured to be slidingly mounted on a frame of the firearm, a lateral side of the slide is configured with a tapped hole; and a charging handle configured to be mounted on the slide, the charging handle comprising:

a handle member adapted to engage the lateral side of the slide, the handle member having at least one threaded through hole traversing a body of the handle member; and at least one screw configured to secure the handle member to the slide through the at least one threaded through hole when the at least one threaded through hole is aligned with the tapped hole on the slide, wherein the handle member has a user-engagement side and a mating side opposite the user-engagement side, wherein the at least one threaded through hole traverses the handle member between the user-engagement side and the mating side, wherein the mating side is configured to contact and mate with the lateral side of the slide when the charging handle is mounted on the lateral side of the slide, wherein the user-engagement side faces outwardly toward a left side or a right side of the firearm when the charging handle is mounted on the lateral side of the slide, and wherein both the at least one threaded through hole and the at least one screw are on the lateral side of the slide when the charging handle is mounted on the lateral side of the slide.

15. The device of claim 14, wherein the lateral side of the slide is further configured with an one indentation approximate the tapped hole.

16. The device of claim 15, wherein the mating side of the handle member has at least one post protruding from the mating side and configured to be received in the at least one indentation on the lateral side of the slide when the charging handle is installed on the slide with the mating side in physical contact with the lateral side of slide.

17. The device of claim 16, wherein the lateral side of the slide is further configured with a groove connecting the indentation and the tapped hole, wherein the mating side of the handle member also has a ridge protruding from the mating side and extending between the post and the at least one threaded through hole, and wherein the ridge is configured to be received in the groove on the lateral side of the slide when the charging handle is installed on the slide.

18. The device of claim 14, wherein a head of the screw is exposed and visible when the charging handle is installed on the slide.

19. The device of claim 14, wherein a material of the handle member comprises metal.

20. The device of claim 14, wherein a material of the handle member comprises polymer.

* * * * *